US009604483B2

(12) United States Patent
Ellonen et al.

(10) Patent No.: US 9,604,483 B2
(45) Date of Patent: Mar. 28, 2017

(54) INKJET PRINTING APPARATUS AND MANUFACTURING METHOD FOR ABSORBENT SUBSTRATE

(71) Applicant: SCA TISSUE FRANCE, Saint-Ouen (FR)

(72) Inventors: Matti Ellonen, München (DE); Yoann Denis, Muttersholtz (FR); Donald Barredo, Ingersheim (FR); Damien Brendle, Obersaasheim (FR)

(73) Assignee: SCA TISSUE FRANCE, Saint-Ouen (FR)

( * ) Notice: Subject to any disclaimer, the term of this patent is extended or adjusted under 35 U.S.C. 154(b) by 0 days.

(21) Appl. No.: 15/109,141

(22) PCT Filed: Feb. 7, 2014

(86) PCT No.: PCT/EP2014/052489
§ 371 (c)(1),
(2) Date: Jun. 30, 2016

(87) PCT Pub. No.: WO2015/117675
PCT Pub. Date: Aug. 13, 2015

(65) Prior Publication Data

US 2016/0375708 A1 Dec. 29, 2016

(51) Int. Cl.
*B41J 29/17* (2006.01)
*B41J 2/01* (2006.01)
(Continued)

(52) U.S. Cl.
CPC ..... *B41J 29/17* (2013.01); *B41J 2/01* (2013.01); *D21H 25/04* (2013.01); *D21H 27/002* (2013.01)

(58) Field of Classification Search
CPC ..... B41J 2002/1853; B41J 29/17
See application file for complete search history.

(56) References Cited

U.S. PATENT DOCUMENTS

2004/0223041 A1 11/2004 Ishikawa
2005/0093919 A1* 5/2005 Takatsuka ..... B41J 2/16523 347/30

(Continued)

FOREIGN PATENT DOCUMENTS

EP 1575778 B1 3/2010
JP S58-147373 A 9/1983
WO WO-2010/042472 A1 4/2010

*Primary Examiner* — Jason Uhlenhake
(74) *Attorney, Agent, or Firm* — Drinker Biddle & Reath LLP

(57) ABSTRACT

An inkjet printing apparatus for printing an image on an absorbent substrate includes a print head unit and a dust removal device. The absorbent substrate includes a print side and an opposite side and is conveyed between the print-head unit and the dust removal device. The print head unit defines a print zone on the print side. The dust removal device includes a pumping chamber formed of a pre-pumping sub-chamber, a print zone sub-chamber, and a post-pumping sub-chamber, said chambers being positioned at the opposite side. The pre-pumping sub-chamber is positioned substantially upstream from the print zone. The print zone sub-chamber is positioned substantially at the print zone. The post-pumping sub-chamber is positioned downstream from the print zone. A second pressure in the print zone sub-chamber is higher than a first pressure in the pre-pumping sub-chamber and a third pressure in the post-pumping sub-chamber so as to create a suction impact to dust particles generated by the conveyed absorbent substrate.

18 Claims, 5 Drawing Sheets

(51) Int. Cl.
*D21H 25/04* (2006.01)
*D21H 27/00* (2006.01)

(56) References Cited

U.S. PATENT DOCUMENTS

| | | | | |
|---|---|---|---|---|
| 2005/0122372 | A1 | 6/2005 | Shimizu | |
| 2005/0128276 | A1* | 6/2005 | Yamada | B41J 2/2103 347/104 |
| 2008/0158273 | A1 | 7/2008 | Yoshikawa et al. | |
| 2012/0062677 | A1* | 3/2012 | Sawada | B41J 2/175 347/104 |

* cited by examiner

INKJET PRINTING APPARATUS AND MANUFACTURING METHOD FOR ABSORBENT SUBSTRATE

CROSS-REFERENCE TO PRIOR APPLICATION

This application is a §371 National Stage Application of PCT International Application No. PCT/EP2014/052489 filed Feb. 7, 2014, which is incorporated herein in its entirety.

TECHNICAL FIELD

An aspect of the disclosure relates to an inkjet printing apparatus for an absorbent substrate. The absorbent substrate may be manufactured from a web of tissue paper (obtained by a Conventional Wet Press or Through Air Drying manufacturing method or other manufacturing method) or a nonwoven fabric (obtained by an air-laid manufacturing method or spun-laid manufacturing method or other manufacturing method). Such an absorbent substrate may be converted into absorbent sheet products that have a particular, though non-exclusive, use as sanitary or domestic purposes. As an example, such absorbent sheet products may be used as napkins in restaurants. Others uses as towels, bath tissues, etc. . . . are possible.

BACKGROUND

A tissue paper relates to an absorbent paper based on cellulose fibers which is also called tissue paper base sheet in this field of technology. A typical absorbent paper has a low basis weight, in the range from 10 to 60 g/m$^2$, or 30 to 50 g/m$^2$.

A nonwoven fabric including cellulosic fibers relates to an absorbent paper which is also called nonwoven or web made of fibers like air-laid web in this field of technology. A typical absorbent paper has a basis weight, in the range from 20 to 300 g/m$^2$, or 40 to 60 g/m$^2$.

The document WO 2010/42472 describes fibrous web substrates and a process for printing a series of different graphics in the manufacture of fibrous web substrates, such as tissue and towel products, utilizing flexographic printing with endless belts and having graphic repeats of at least about 58 inches. In addition, these substrates have color to color MD registration of less than about 1.5 mm.

However, this printing apparatus is not adapted to custom print on absorbent sheet products because of the limitation to one pattern/cliché per impression cylinder and also the complexity/time required for changing an impression cylinder in an industrial flexographic printing line. Flexographic printing is well adapted for printing identical pattern at an industrial manufacturing speed (up to 1,000 m/min) for high volume of products (e.g. a thousand absorbent sheet products) and at a low cost.

The document EP 1575778 describes a method of creating high-speed multi-color process images. The method includes providing at least two high operating frequency printheads which are capable of processing phase-change inks, providing at least two phase-change inks, providing a substrate, activating the printheads such that at least two inks pass therethrough, and passing the substrate under the printheads at a rate of at least about 1000 ft/min (i.e. around 305 m/min) so as at least one process image is formed on the substrate. This document also describes a process for achieving high-speed crockfast process printing on a material with phase-change ink. The process includes providing at least an array of printheads capable of processing phase-change inks at frequencies of at least about 20 kHz, providing a material, providing a material transport system capable of transporting the material under the printheads, providing a plurality of phase-change inks, transporting material under the array printheads at a speed of at least 1.000 ft/min, and ejecting ink from at least two of the printheads onto the material so as to form an image.

This document is concerned with the "personal care articles/products" or "personal care absorbent product" such as feminine hygiene articles, diapers, baby pull-on articles, baby wipes, sanitary wipes, wet wipes, baby swim articles, adult incontinence articles, training pants, swim wear, absorbent underpants, wound dressings, nursing pads, time release patches, bandages, mortuary products, veterinary products and the like. However, this printing apparatus is not adapted to print on absorbent substrates that generate fiber dust due to the nature of the product that is running in a converting machine, operating at an industrial speed.

Thus, there is a need to improve quality of printing, uniformity of printing, runnability in a converting machine that may be used to custom print absorbent substrates (tissue papers and/or nonwovens), and also to avoid wasting time on the maintenance of the print heads. Further, this should be obtained in an economical or a cost-effective manner.

SUMMARY

It is desired for an inkjet printing apparatus that overcomes the drawbacks of the prior art printing apparatus. In particular, it is desirable to avoid, or at least to reduce, the contamination of the print heads by fiber dust generated by absorbent substrates, in particular tissue papers and/or nonwovens. More particularly, it is desired to solve this issue even at a level of dust generated by absorbent substrates running at an industrial manufacturing speed in a converting machine (e.g. up to 1,000 m/min).

According to one aspect, there is provided an inkjet printing apparatus for printing an image on an absorbent substrate, the inkjet printing apparatus including a print head unit and a dust removal device, the absorbent substrate including a print side and an opposite side, the absorbent substrate being conveyed between the print head unit and the dust removal device, the print head unit defining a print zone on the print side, wherein the dust removal device includes a pumping chamber formed of a pre-pumping sub-chamber, a print zone sub-chamber and a post-pumping sub-chamber, said chambers being positioned at the opposite side, wherein the pre-pumping sub-chamber is positioned substantially upstream from the print zone, the print zone sub-chamber is positioned substantially at the print zone, the post-pumping sub-chamber is positioned downstream from the print zone, and wherein a second pressure in the print zone sub-chamber is higher than a first pressure in the pre-pumping sub-chamber and a third pressure in the post-pumping sub-chamber so as to create a suction impact to dust particles generated by the conveyed absorbent substrate.

The first pressure in the pre-pumping sub-chamber may be substantially similar to the third pressure in the post-pumping sub-chamber.

The first, second and third pressures may be lower or equal than a fourth pressure existing substantially around the print side of the absorbent substrate.

The second pressure in the print zone sub-chamber may be between 10 hPa to 40 h higher than said pressure in the pre-pumping sub-chamber or in the post-pumping sub-chamber.

The fourth pressure at the print zone may be around the atmospheric pressure, said pressure in the pre-pumping sub-chamber or in the post-pumping sub-chamber is between 10 hPa to 40 h lower than the atmospheric pressure.

The pre-pumping sub-chamber, the print zone sub-chamber and the post-pumping sub-chamber may be coupled to at least one pump through a first, second and third regulation valve, respectively.

A portion of the pumping chamber facing the print head unit may be a porous plate.

The inkjet printing apparatus may further include a transport belt arrangement including an endless belt for supporting and conveying the absorbent substrate between the print head unit and the pumping chambers, said endless belt being made of a porous material and/or is perforated.

The inkjet printing apparatus may further include a suction drum for supporting and conveying the absorbent substrate between the print head unit and the pumping chambers, said suction drum having a peripheral surface made of a porous material and/or is perforated.

The dust removal device may further include a controlled pressure chamber covering the print zone, the print head unit and the pumping chambers so that the fourth pressure at the print zone is varied positively or negatively around the atmospheric pressure.

The dust removal device may further include an air-knife arrangement upstream from the print zone, the air-knife arrangement including an air-knife blower blowing a flow of air to an opposite direction from the print zone.

The air-knife arrangement may further include a suction nozzle facing the air-knife blower.

The dust removal device may further include a first top suction nozzle positioned at the print side of the absorbent substrate upstream from the print zone.

The dust removal device may further include a second top suction nozzle positioned at the print side of the absorbent substrate, downstream from the print zone.

The dust removal device may further include a first lateral bottom suction zone and a second lateral bottom suction zone positioned at the print zone on both lateral sides of the print head unit and at the opposite side.

According to another aspect, there is provided a use of the inkjet printing apparatus described above for manufacturing absorbent sheet products chosen among the group of napkins, towels, kitchen towels, hand towels, toilet papers, wipes and facial tissues.

According to still another aspect, there is provided a method of manufacturing printed absorbent substrate including the step of printing an image on an absorbent substrate by means of an inkjet printing apparatus including a print head unit and a dust removal device, the absorbent substrate including a print side and an opposite side, the print head unit defining a print zone on the print side, the manufacturing method including the steps of:

conveying the absorbent substrate between the print head unit and the dust removal device, submitting the absorbent substrate to a first pressure substantially upstream the print zone and at the opposite side, a second pressure at the print zone and at the opposite side, a third pressure substantially downstream the print zone and at the opposite side, wherein the second pressure is higher than said first pressure and third pressure so as to create a suction impact to dust particles generated by the conveyed absorbent substrate.

According to still a further aspect, there is provided a printed absorbent substrate produced according to the manufacturing methods described above.

With embodiments described above, it is possible to print unique absorbent sheet products with specific patterns (e.g. one napkin with one unique pattern). Further, the inkjet printing technology enables improving quality and runnability in the context of industrial printing of absorbent substrates which generate a significantly process disturbing amount of dust when being ran at an industrial manufacturing speed on a converting line.

Other advantages will become apparent from the hereinafter description of embodiments of the invention.

BRIEF DESCRIPTION OF THE DRAWINGS

Embodiments of the present invention are illustrated by way of examples and not limited to the accompanying drawings, in which like references indicate similar elements.

DETAILED DESCRIPTION OF PARTICULAR EMBODIMENTS

Figure 1:
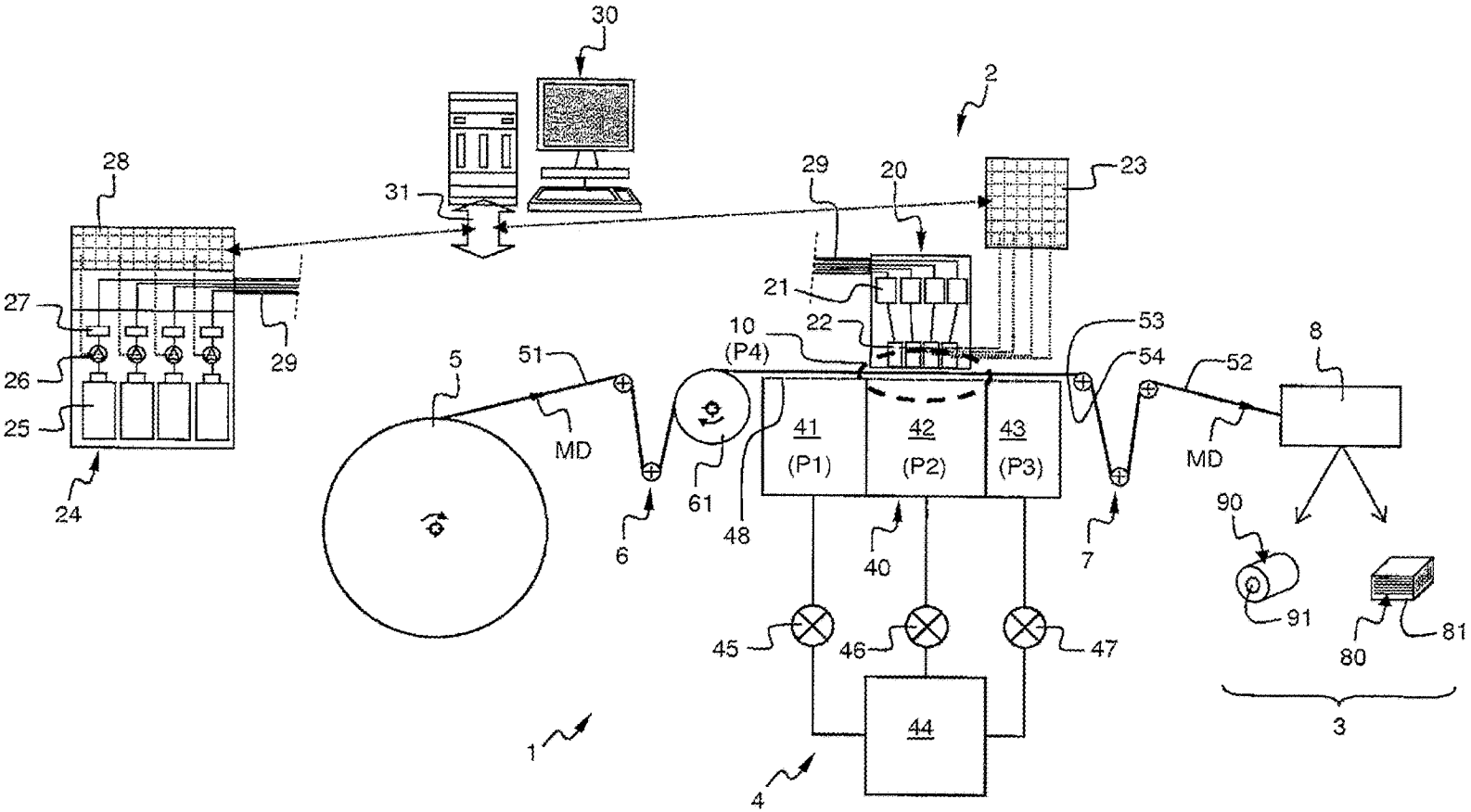
FIG. 1 is a partial side cross-section view schematically illustrating a converting machine/line including an exemplary embodiment of an inkjet printing apparatus for absorbent substrates fitted with a dust removal device.

FIG. 1 is a partial side cross-section view schematically illustrating a converting machine or line 1 that includes an exemplary embodiment of an inkjet printing apparatus 2 used to print on absorbent sheet products 3.

The converting machine or line 1 includes a supply roll 5, the inkjet printing apparatus 2, multiple transport rolls 6, 7, and a final converting unit 8. A continuous web of absorbent substrate 51 is led to a print zone 10 from the supply roll 5 by a first series of transport rolls 6. Then, the web of absorbent substrate 51 is printed by means of the inkjet printing apparatus 2. Subsequently, the resulting printed absorbent substrate 52 is led to the final converting unit 8 from the print zone 10 by a second series of transport rolls 7.

In this embodiment, the supply roll 5 supplies a web of absorbent substrate 51 including one ply. However, it may supply a web of absorbent substrate of two, three or more plies, namely two, three or more independent layers associated or not together. The multiple transport rolls are arranged and positioned relatively to the supply roll and the print zone in order to transport the web substantially horizontally and with appropriate tension according to the machine direction MD into the print zone 10.

The inkjet printing apparatus 2 includes a print head unit 20, a print head management module 23, an ink supply unit 24 and a print controlling arrangement 30. In this exemplary embodiment, the inkjet printing apparatus 2 is arranged to print colored images based on four different primary colors, e.g. black, magenta, yellow and cyan. The print head unit 20 includes four ink header tanks 21 coupled to four print heads 22. The print heads 22 include multiple nozzles for jetting ink droplets, e.g. with a resolution of around few hundred of dpi (dots per inch), said resolution may be dependent on the cross-machine direction CD or machine direction MD, each droplet being, for example, below hundred picoliter, the print head being operated, for example, from 1 Hz to 10 MHz. The ink supply unit 24 includes four ink bottles 25, four ink pumps 26, four ink supply filters 27 and an ink supply control module 28. The ink supply unit 24 is coupled to the print head unit 20 by four ink supply channels 29. The print controlling arrangement 30 is connected to the print head management module 23 and the ink supply control module 28 through a communication interface 31. As it is usual in the arts, a software is run by a processor of the print controlling arrangement 30 that controls the operation of the ink pumps 26 through the ink supply control module 28, and also of the print heads 22 through the print head management module 23. As a result, various electronic images (the word "images" has a broad meaning including graphics, photos, patterns, motives, barcodes, QR (quick response) codes, texts, printed electronics, etc. . . . ) stored in the memory of the print controlling arrangement 30 can be appropriately printed onto the web of absorbent product 51. The resolution, brightness, color saturation, etc. . . . of the electronic image printed on the web of absorbent product can be finely controlled. Therefore, a unique image, a succession of different images, customized images, and combinations of a background image with variable/customized images can be easily and quickly printed. With such an inkjet printing apparatus, changing from one image currently printed to another image to be printed is a mere matter of seconds while it would have required a few hours utilizing the flexographic printing technology. In the present description, the print zone 10 is considered to be a zone defined by an area below the print head unit 20 encompassing the length where the ink droplets impact the web of the absorbent substrate in the machine direction MD while totally covering the width of the web of absorbent substrate in the cross-machine direction CD. The print head unit 20 of the inkjet printing apparatus 2 may be fitted onto a motorized table (not shown in the FIGS) enabling the print head unit 20 to be moved across the full width of the web of absorbent product (see FIG. 7).

After the printing step, the printed tissue 52 is then further converted into an absorbent sheet product 3 by the final converting unit 8. As a first example (reel to roll converting example), the printed tissue 52 may be wound onto a core 91 as a roll 90. The printed tissue 52 may be wound as a log that is cut into multiple individual roll 90. As a second example (reel to sheet converting example), the printed tissue 52 may be cut into individual absorbent sheet products of appropriate lengths by a cutting roller. Further, the individual absorbent sheet products may be then transported to a folding unit. Then, the individual absorbent sheet products 80 resulting from the cutting and folding operation may be packaged as stacks 81. All these operations (wounding, cutting, folding, packaging) that may be performed by the final converting unit 8 are not germane to the present invention and will not be further described. The printed tissue paper product may be used as napkins, paper towel, toilet tissue rolls, bathroom tissue, wiping tissue, kitchen tissue rolls, facial tissue or handkerchiefs, etc. . . . .

The web of absorbent substrate 51 is unwound at an appropriate speed towards the print zone 10. Typically, according to industrial manufacturing process, the web of absorbent substrate is run at a speed ranging from 20 to 1,000 m/min (this mainly depends on the type of printed tissue paper products to be produced), the print head being at a distance ranging from 0.1 to 20 mm from the running web of absorbent substrate. The web of absorbent substrate 51 includes a print side 53 and an opposite side 54 of the print side. More precisely, the opposite side 54 is the side opposite to the print side 53, the print side 53 being the side facing the print-head unit 20.

According to the invention, the inkjet printing apparatus 2 is fitted with a dust removal device 4. The dust removal device 4 will also be further described in details in relation with various other embodiments shown in FIGS. 2 to 5. Surprisingly, the inventors have discovered that a dust removal device including a single chamber positioned upstream, below and downstream the print zone 10 distributing a similar partial vacuum and sucking effect upstream, below and downstream the print zone 10 is not satisfactory when printing at the hereinbefore mentioned industrial speed. Indeed, in such a configuration, the dust removal device creates various issues ranging from resolution issue of the printed image onto the absorbent substrate by randomly deviating the droplets (typical line breaks are observed at important level of vacuum) to low quality issue resulting from nozzles clogging by the fiber dust (typical phantom traces are observed at low level of vacuum). The inventors have discovered a particular configuration of the dust removal device that solves the above issues and provides satisfying resolution without clogging issue at industrial production speed. Such a configuration as described below authorizes around a few dozen of thousand prints without requiring any cleaning of the print heads 22. This is particularly satisfactory in the context of industrial manufacturing.

The web of absorbent substrate 51 is conveyed between the print-head unit 20 and the dust removal device 4. The dust removal device 4 includes chambers that are positioned at the opposite side of the web of absorbent substrate 51.

Figure 7:
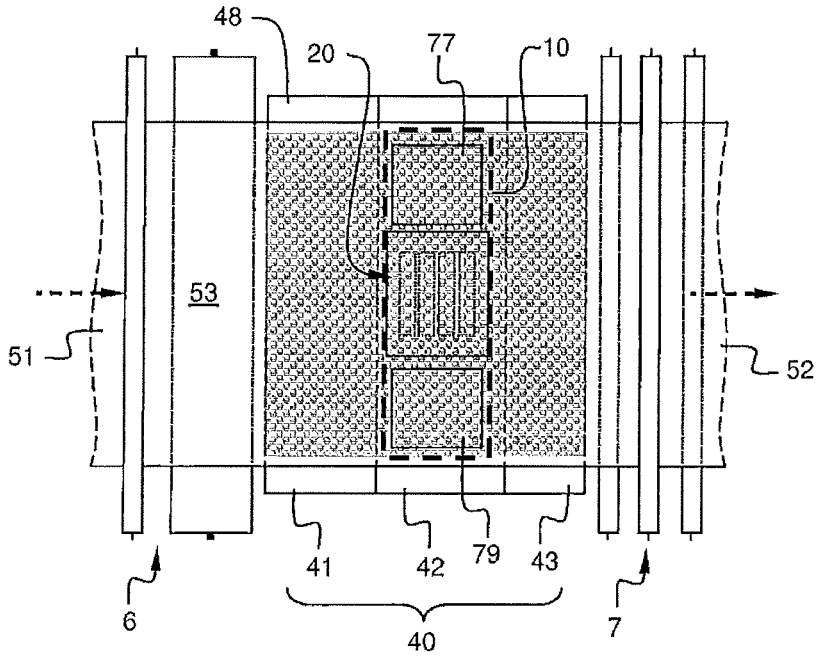
FIG. 7 is a partial top view schematically illustrating the exemplary embodiments of an inkjet printing apparatus for absorbent substrates of FIGS. 1 to 4.

The dust removal device 4 includes a pumping chamber 40, a first 45, second 46 and third 47 regulation valves, and a pump 44. The pumping chamber 40 includes three independent pumping sub-chambers, namely a pre-pumping sub-chamber 41, a print zone sub-chamber 42 and a post-pumping sub-chamber 43. The pre-pumping sub-chamber 41 is positioned upstream the print zone 10 and below (i.e. at the opposite side of the print side) the moving web of absorbent substrate 51. The pre-pumping sub-chamber 41 is coupled to the pump 44 through the first regulation valve 45. The print zone sub-chamber 42 is positioned at and below (i.e. at the opposite side of the print side) the print zone 10. The print zone sub-chamber 42 is coupled to the pump 44 through the second regulation valve 46. The post-pumping sub-chamber 43 is positioned downstream the print zone 10 and below (i.e. at the opposite side of the print side) the moving web of absorbent substrate 51. The post-pumping sub-chamber 43 is coupled to the pump 44 through the third regulation valve 47. The pump and the regulation valve are used to create a partial vacuum in the associated chamber having the function of sucking the dust particles in the zones upstream, at and downstream the print zone 10. The portion of the pumping chamber 40 facing/supporting the moving web of absorbent substrate 51 can be realized under the form of a porous plate 48, meaning that it is an air-passing plate. As an example, the porous plate 48 may be a perforated plate. The perforated plate may comprise a series of holes arranged in rows and columns positioned along the width of the web of absorbent substrate in the cross-machine direction with a density such that the moving web of absorbent substrate 51 is correctly supported and the sucking function is satisfactory and regularly distributed over at least the print zone 10 or over the whole web of absorbent substrate width. FIG. 7 is a partial top view schematically illustrating such an exemplary embodiment partially showing the porous plate 48 and a moving web of absorbent substrate 51, 52 upstream, at and downstream the print zone 10.

In an exemplary embodiment particularly adapted to napkins made of two plies of tissue paper, a first pressure P1 (or level of vacuum) in the pre-pumping sub-chamber 41 is substantially similar to a third pressure P3 in the post-pumping sub-chamber 43 for example in a range between 10 hPa and 40 hPa below the atmospheric pressure (e.g. 1013 hPa), namely between 1003 hPa and 973 hPa. A second pressure P2 in the print zone sub-chamber 42 is higher than said pressures P1 and P3 in the pre-pumping sub-chamber 41 and in the post-pumping sub-chamber 43, respectively. For example, the second pressure P2 in the print zone sub-chamber 42 may be at or slightly below the atmospheric pressure, e.g. lower or equal to 1013 hPa. All said pressures P1, P2, P3 are lower than a fourth pressure P4 at and above the print zone 10, which may be at or around the atmospheric pressure, e.g. 1013 hPa. All these pressures are given as non-limitative examples; they can be adjusted by means of the pump(s) and/or regulation valve(s) to other values that are adapted to the type of absorbent substrate/running speed/other converting parameters.

Figure 2:
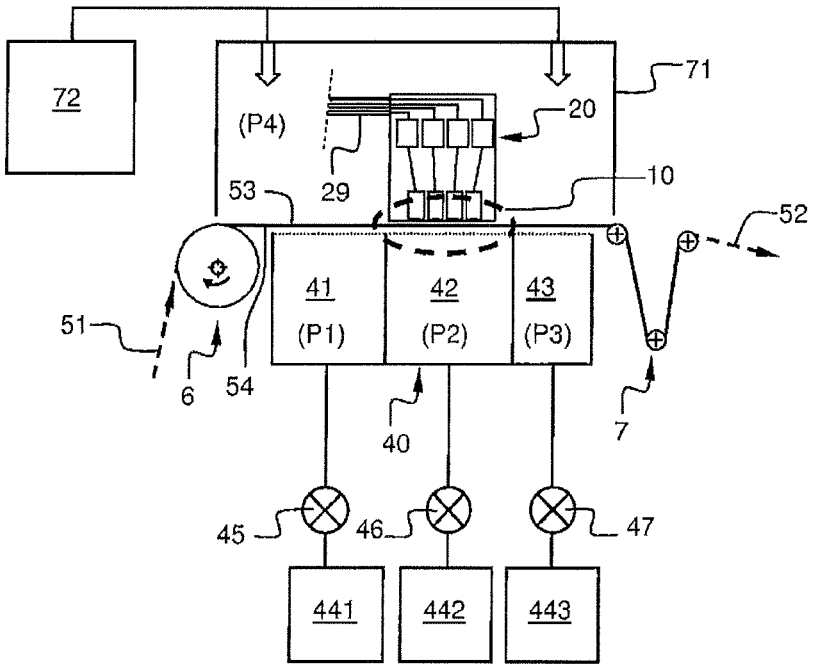
FIGS. 2 to 4 are partial side cross-section views schematically illustrating other exemplary embodiments of inkjet printing apparatuses for absorbent substrates.

FIG. 2 is a partial side cross-section view schematically illustrating another exemplary embodiment of an inkjet printing apparatus for absorbent substrates. In this exemplary embodiment, the dust removal device 4 further includes a controlled pressure chamber 71 that covers above the print zone 10, the print head unit 20 and the pumping chamber 40. The controlled pressure chamber 71 is coupled to a second pump 72. The fourth pressure P4 created in the controlled pressure chamber 71 may be above the atmospheric pressure so as to strengthen the flow of dust particles towards the pumping chamber 40. However, the pressure may also be varied so as to be lower than the atmospheric pressure. Further, as an option, the single pump 44 has been replaced by three pumps 441, 442 and 443. The first pump 441 is coupled to the pre-pumping sub-chamber 41 through the first regulation valve 45. The second pump 442 is coupled to the print zone sub-chamber 42 through the second regulation valve 46. The third pump 443 is coupled to the post-pumping sub-chamber 43 through the third regulation valve 47. Therefore, each pump is associated with a specific sucking area/volume.

Figure 3:
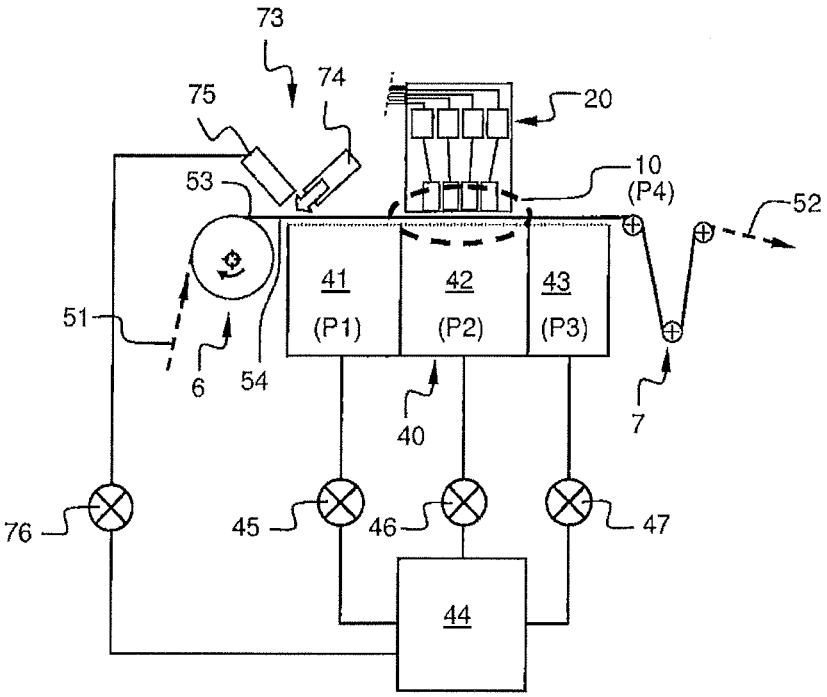

FIG. 3 is a partial side cross-section view schematically illustrating another exemplary embodiment of an inkjet printing apparatus for absorbent substrates. In this exemplary embodiment, the dust removal device 4 further includes an air-knife arrangement 73 upstream the print zone 10. The air-knife arrangement 73 includes an air-knife blower 74 that blows a flow of air in a direction opposite to the print zone 10. The air-knife arrangement 73 may further include a suction nozzle 75 facing the air-knife blower 74 so as to suck the flow of air having impinged the moving web of absorbent substrate 51. The suction nozzle 75 is coupled to the pump 44 through a fourth regulation valve 76.

Figure 4:
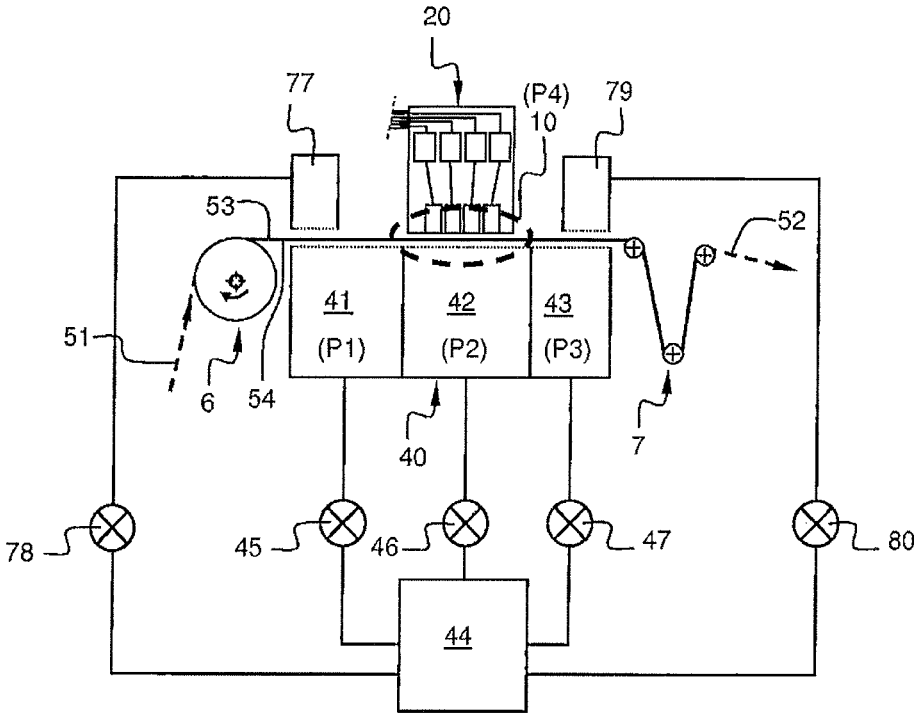
Figure 8:
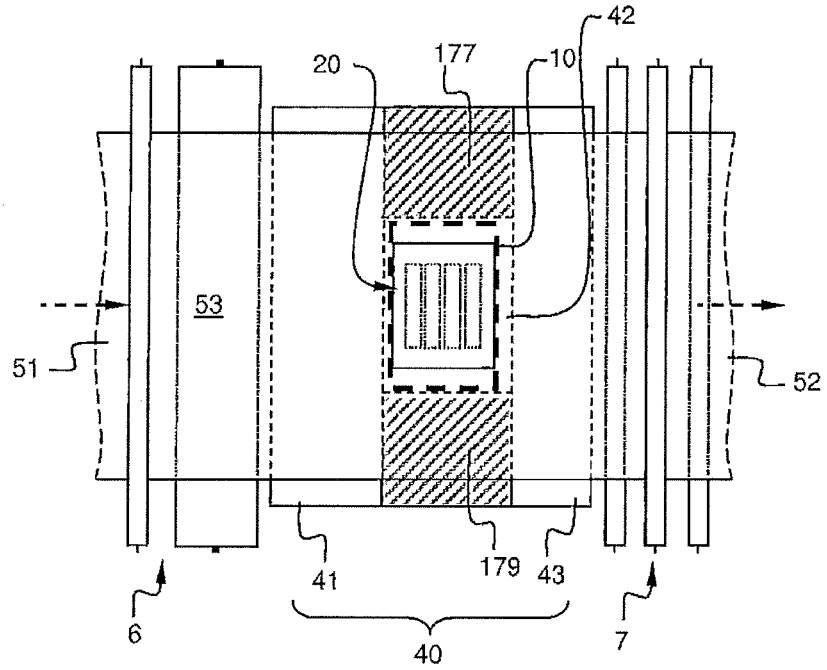
FIG. 8 is a partial top view schematically illustrating a modified embodiment based on the exemplary embodiments of an inkjet printing apparatus for absorbent substrates of FIGS. 1 to 4.

FIG. 4 is a partial side cross-section view schematically illustrating another exemplary embodiment of an inkjet printing apparatus for absorbent substrates. In this exemplary embodiment, the dust removal device 4 further includes a first top suction nozzle 77 positioned above the moving web of absorbent substrate 51 upstream the print zone 10. The first top suction nozzle 77 may be coupled to the pump 44 through a fifth regulation valve 78. Optionally, the dust removal device 4 may further include a second top suction nozzle 79 positioned above the moving printed web of absorbent substrate 52 downstream the print zone 10. The second top suction nozzle 79 may be coupled to the pump 44 through a sixth regulation valve 80. Alternatively, as depicted on FIG. 7, the first top suction nozzle 77 and the second top suction nozzle 79 can also be positioned at the print zone 10 on both lateral sides (according to the CD direction) of the print head unit 20. Alternatively, as depicted on FIG. 8, the first top suction nozzle 77 and the second top suction nozzle 79 may also be combined with a first lateral bottom suction zone 177 and a second lateral bottom suction zone 179 (depicted as hatched areas). These zones are positioned at the print zone 10 on both lateral sides (according to the CD direction) of the print head unit 20, and at the opposite side 54. Accordingly, the lateral extension of the print zone sub-chamber 42 is limited to enable having such lateral bottom suction zones 177 and 179 positioned at the same level. Further, as a consequence, the lateral extension of the print zone 10 is also limited. The porous plate 48 is not shown on FIG. 8 for sake of drawing clarity. The level of pressure generated by the top suction nozzle or the suction zone is analogous to either the first pressure P1 or the third pressure P3 that have been exemplified hereinbefore.

All and/or some of the various exemplary embodiments of inkjet printing apparatuses for absorbent substrates hereinbefore described with respect to FIGS. 2 to 4 may be combined together.

Figure 5:
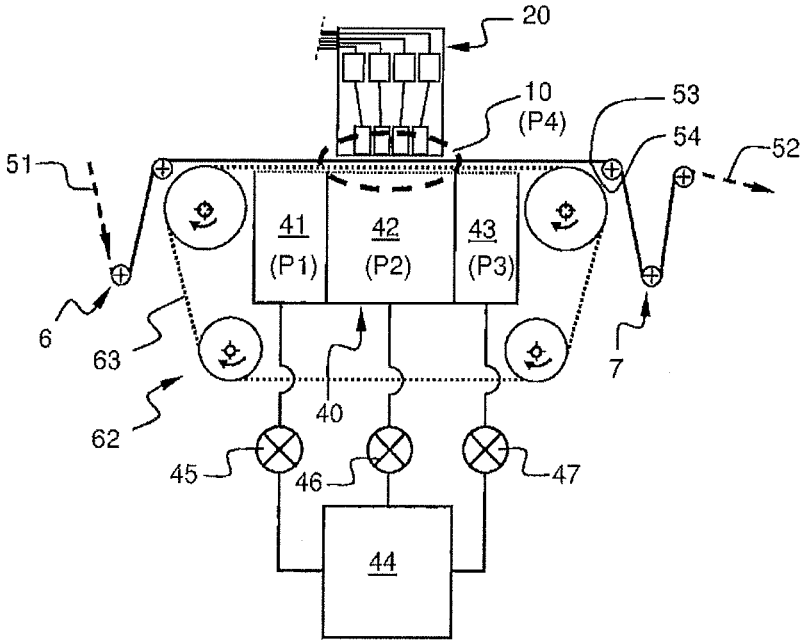
FIG. 5 is a partial side cross-section view schematically illustrating another exemplary embodiment of an inkjet printing apparatus for absorbent substrates further fitted with a transport belt arrangement.
Figure 6:
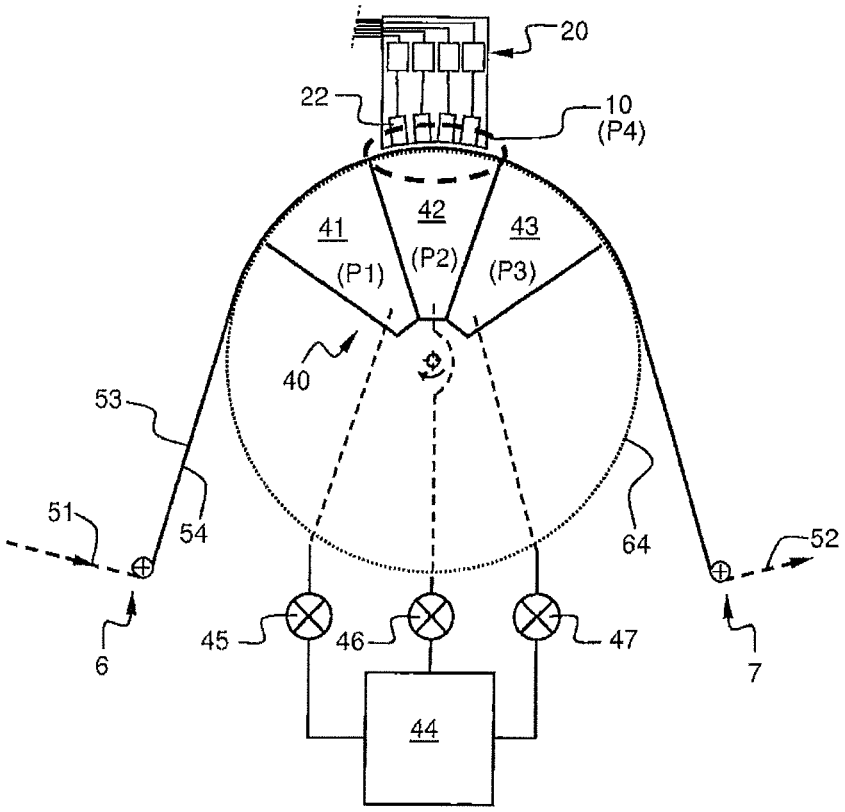
FIG. 6 is a partial side cross-section view schematically illustrating still another exemplary embodiment of an inkjet printing apparatus for absorbent substrates further fitted with a suction drum.

FIG. 5 is a partial side cross-section view schematically illustrating another exemplary embodiment of an inkjet printing apparatus for absorbent substrates further fitted with a transport belt arrangement. In the embodiments depicted in FIGS. 1 to 4 and 7, the transport rolls 6 upstream the print zone 10 includes a stabilizing roller 61, for example an abrasive roller. Such a stabilizing roller 61 is used to avoid tensioning issues of the moving web of absorbent substrate at the print zone 10, i.e. the web is conveyed through the print zone in a stable and controlled speed/tension. As an alternative, such a tension controlling function can be implemented by using a transport belt arrangement 62. The transport belt arrangement 62 includes multiple rollers supporting an endless belt 63. The endless belt 63 is made of a porous material and/or is perforated such that the moving web of absorbent substrate 51 is correctly supported and conveyed while the sucking function through the belt is not impaired. Alternatively, the endless belt 63 may be a non-gliding belt. As another alternative depicted in FIG. 6, such a tension controlling function can also be implemented by using a suction drum 64. The suction drum 64 has a peripheral surface made of a porous material and/or is perforated such that the moving web of absorbent substrate 51 is correctly supported and conveyed while the sucking function through the drum is not impaired. In this alternative, the three independent pumping sub-chambers, namely the pre-pumping sub-chamber 41, the print zone sub-chamber 42 and the post-pumping sub-chamber 43 of the pumping chamber 40 are integrated within the suction drum 64. These sub-chambers have the shape of sectors in cross-section, for example with an angle of around 15° (the drum being generally cylindrical in shape).

The drawings and their descriptions hereinbefore illustrate rather than limit the invention.

Though the invention has been described with respect to various embodiments of inkjet printing apparatuses for absorbent substrates, these are not limitative examples. The skilled person will readily recognize that the embodiments include one print head may be improved with multiple print head positioned according to the machine direction MD and/or the cross-machine direction CD with the purpose of increasing the resolution of the printed image, and/or the printing speed, and/or the dimension of the print zone. Further, most of the embodiments have been described with multiple sucking areas/volumes coupled to a single pump. However, this single pump may be replaced by multiple pumps, for example each sucking area/volume may be coupled to a specific pump as depicted in FIG. 2. Furthermore, also the drawings seem to indicate that the pump is coupled underneath the various sucking areas/volumes; this is for a mere reason of clarity of the drawings because the pump may be, for example, coupled laterally to the various sucking areas/volumes. The pump may further include an exhaust duct (not shown) that expels the collected dust outside the print-area towards e.g. a container (not shown). Furthermore, though the drawings show a vertical positioning of the print head unit relatively to the pumping chamber, this is a mere example because the print head unit is positioned above the absorbent substrate and the pumping chamber is positioned below the absorbent substrate together with the absorbent substrate moving horizontally. However, any other kind of positioning of these elements of the inkjet printing apparatus is possible, for example a horizontal positioning with the absorbent substrate moving vertically, or a positioning at angle. This depends mainly on the particular configuration/orientation of the converting machine or line 1. Indeed, what is important is that the absorbent substrate is conveyed between the print-head unit and the dust removal device, and that the chambers of the dust removal device are positioned at the opposite side of the absorbent substrate (the opposite side being the side opposite to the print side, the print side being the side facing the print-head unit).

The application of the absorbent product is wide in the domain of sanitary or domestic applications wherein a customization of the product with specific imprint is to be done, e.g. napkins, towels, kitchen towels, hand towels, toilet papers, wipes, facial tissues, bath tissues etc. . . . .

Any reference sign in a claim should not be construed as limiting the claim. The word "comprising" does not exclude the presence of other elements than those listed in a claim. The word "a" or "an" or "at least one" preceding an element does not exclude the presence of a plurality of such element.

The invention claimed is:

1. An inkjet printing apparatus for printing an image on an absorbent substrate comprising a print side and an opposite side, the inkjet printing apparatus comprising:

a print head unit defining a print zone on the print side; and a dust removal device comprising a pumping chamber formed of a pre-pumping sub-chamber, a print zone sub-chamber and a post-pumping sub-chamber, said chambers being positioned at the opposite side, wherein the absorbent substrate is conveyed between the print head unit and the dust removal device, wherein the pre-pumping sub-chamber is positioned substantially upstream from the print zone, the print zone sub-chamber is positioned substantially at the print zone, and the post-pumping sub-chamber is positioned downstream from the print zone, and wherein the print zone sub-chamber, the pre-pumping sub-chamber, and the post-pumping sub-chamber are arranged such that a second pressure in the print zone sub-chamber is higher than a first pressure in the pre-pumping sub-chamber and a third pressure in the post-pumping sub-chamber so as to create a suction impact to dust particles generated by the conveyed absorbent substrate.

2. The inkjet printing apparatus of claim 1, wherein the first pressure in the pre-pumping sub-chamber is substantially similar to the third pressure in the post-pumping sub-chamber.

3. The inkjet printing apparatus according to claim 2, wherein the second pressure in the print zone sub-chamber is between 10 hPa to 40 higher than said pressure in the pre-pumping sub-chamber or in the post-pumping sub-chamber.

4. The inkjet printing apparatus according to claim 1, wherein said first, said second, and said third pressures are lower or equal than a fourth pressure existing substantially around the print side of the absorbent substrate.

5. The inkjet printing apparatus according to claim 4, wherein the fourth pressure is around the atmospheric pressure, said pressure in the pre-pumping sub-chamber or in the post-pumping sub-chamber is between 10 hPa to 40 hPa lower than the atmospheric pressure.

6. The inkjet printing apparatus according to claim 4, wherein the dust removal device further comprises a controlled pressure chamber covering the print zone, the print head unit, and the pumping chambers so that the fourth pressure at the print zone is varied positively or negatively around the atmospheric pressure.

7. The inkjet printing apparatus according to claim 1, wherein the pre-pumping sub-chamber, the print zone sub-chamber, and the post-pumping sub-chamber are coupled to at least one pump through a first, second, and third regulation valves, respectively.

8. The inkjet printing apparatus according to claim 1, wherein a portion of the pumping chamber facing the print head unit is a porous plate.

9. The inkjet printing apparatus according to claim 1, further comprising a transport belt arrangement comprising an endless belt for supporting and conveying the absorbent substrate between the print head unit and the pumping chambers, said endless belt being made of a porous material and/or being perforated.

10. The inkjet printing apparatus according to claim 1, further comprising a suction drum for supporting and conveying the absorbent substrate between the print head unit and the pumping chambers, said suction drum having a peripheral surface made of a porous material and/or being perforated.

11. The inkjet printing apparatus according to claim 1, wherein the dust removal device further comprises an air-knife arrangement upstream from the print zone, the air-knife arrangement comprising an air-knife blower blowing a flow of air to an opposite direction from the print zone.

12. The inkjet printing apparatus of claim 11, wherein the air-knife arrangement further comprises a suction nozzle facing the air-knife blower.

13. The inkjet printing apparatus according to claim 1, wherein the dust removal device further comprises a first top suction nozzle positioned at the print side of the absorbent substrate upstream from the print zone.

14. The inkjet printing apparatus according to claim 1, wherein the dust removal device further comprises a second top suction nozzle positioned at the print side of the absorbent substrate, downstream from the print zone.

15. The inkjet printing apparatus according to claim 1, wherein the dust removal device further comprises a first lateral bottom suction zone and a second lateral bottom suction zone positioned at the print zone on both lateral sides of the print head unit and at the opposite side.

16. A method comprising printing on an absorbent sheet chosen among the group consisting of napkins, towels, kitchen towels, hand towels, toilet papers, wipes, and facial tissues using the inkjet printing apparatus according to claim 1.

17. A method of manufacturing a printed absorbent substrate by an inkjet printing apparatus comprising a print head unit and a dust removal device, the absorbent substrate comprising a print side and an opposite side, the print head unit defining a print zone on the print side, the manufacturing method comprising:

conveying the absorbent substrate between the print head unit and the dust removal device;

submitting the absorbent substrate to a first pressure substantially upstream from the print zone and at the opposite side, a second pressure at the print zone, and at the opposite side, a third pressure substantially downstream from the print zone and at the opposite side, wherein the second pressure is higher than said first pressure and third pressure so as to create a suction impact to dust particles generated by the conveyed absorbent substrate.

18. A printed absorbent substrate produced according to the manufacturing method of claim 17.

* * * * *